US006372123B1

(12) United States Patent
Kresnyak et al.

(10) Patent No.: US 6,372,123 B1
(45) Date of Patent: Apr. 16, 2002

(54) METHOD OF REMOVING WATER AND CONTAMINANTS FROM CRUDE OIL CONTAINING SAME

(75) Inventors: Steve Kresnyak; Fred Shaw, both of Calgary (CA)

(73) Assignee: Colt Engineering Corporation, Calgary (CA)

( * ) Notice: Subject to any disclaimer, the term of this patent is extended or adjusted under 35 U.S.C. 154(b) by 0 days.

(21) Appl. No.: 09/604,577

(22) Filed: Jun. 27, 2000

(51) Int. Cl.[7] ..... C10G 33/00
(52) U.S. Cl. ..... 208/187
(58) Field of Search ..... 208/187

(56) References Cited

U.S. PATENT DOCUMENTS

| | | | | | |
|---|---|---|---|---|---|
| 1,547,100 | A | * | 7/1925 | Daughdrill | 208/187 |
| 1,559,036 | A | | 10/1925 | Egloff et al. | 208/187 |
| 1,652,166 | A | * | 12/1927 | Dubbs | 208/187 |
| 1,656,710 | A | * | 1/1928 | Rudigier | 208/187 |
| 3,091,098 | A | | 5/1963 | Bowers | 62/180 |
| 3,318,803 | A | | 5/1967 | Broughton | 208/187 |
| 3,411,992 | A | | 11/1968 | Mitchell | 203/11 |
| 3,441,499 | A | | 4/1969 | Francis, Jr. et al. | 208/187 |
| 3,453,205 | A | | 7/1969 | Francis, Jr. et al. | 208/187 |
| 3,474,764 | A | | 10/1969 | Sargeant | 122/34 |
| 3,553,100 | A | | 1/1971 | Jorda et al. | 208/11 |
| 3,608,638 | A | | 9/1971 | Terwilliger | 166/272 |
| 3,619,416 | A | * | 11/1971 | Hendry | 208/187 |
| 3,622,466 | A | | 11/1971 | West | 203/1 |
| 3,637,018 | A | | 1/1972 | Kelly et al. | 166/272 |
| 3,644,194 | A | | 2/1972 | Kelly et al. | 208/11 |
| 3,648,771 | A | | 3/1972 | Kelly et al. | 166/272 |
| 3,660,268 | A | | 5/1972 | Kelly et al. | 208/11 |
| 3,684,699 | A | | 8/1972 | Vermeulen et al. | 208/188 |
| 3,796,652 | A | * | 3/1974 | Lupul | 208/39 |
| 3,800,873 | A | | 4/1974 | Kelly et al. | 166/272 |
| 3,802,508 | A | | 4/1974 | Kelly et al. | 166/272 |
| 3,847,616 | A | | 11/1974 | Kaneko et al. | 96/94 |
| 3,853,672 | A | | 12/1974 | Gordon et al. | 159/2 |
| 3,888,543 | A | | 6/1975 | Johns | 299/11 |
| 3,888,760 | A | * | 6/1975 | Ebert | 208/48 |
| 3,910,834 | A | | 10/1975 | Anderson | 208/59 |
| 3,913,672 | A | | 10/1975 | Allen et al. | 166/263 |
| 3,917,811 | A | | 11/1975 | Grout et al. | 423/659 |
| 3,923,643 | A | | 12/1975 | Lewis et al. | 208/179 |
| 3,923,644 | A | * | 12/1975 | Hindman | 208/186 |
| 3,948,754 | A | | 4/1976 | McCollum et al. | 208/11 |
| 3,948,755 | A | | 4/1976 | McCollum et al. | 208/11 |
| 3,954,141 | A | | 5/1976 | Allen et al. | 166/274 |
| 3,958,830 | A | | 5/1976 | Johns | 299/31 |
| 4,004,636 | A | | 1/1977 | Brown et al. | 166/272 |
| 4,017,377 | A | | 4/1977 | Fairbanks, Jr. et al. | 208/11 |
| 4,019,578 | A | | 4/1977 | Terry et al. | 166/267 |

(List continued on next page.)

FOREIGN PATENT DOCUMENTS

| | | | |
|---|---|---|---|
| CA | 1302937 | 6/1992 | C10G/33/00 |
| CA | 1307489 | 9/1992 | C10G/33/00 |
| CA | 2179760 | 12/1997 | C10G/33/00 |
| CA | 2191684 | 5/1998 | C10G/31/08 |

*Primary Examiner*—Nadine Preisch
(74) *Attorney, Agent, or Firm*—Paul S. Sharpe; Marks & Clerk

(57) ABSTRACT

A method for contaminant and water removal from crude oil. The method involves recirculating at least a portion of the dewatered crude into a dehydrator. The dehydrator contains a heated dehydrated crude oil and the surface or adjacent thereto is maintained at a temperature sufficient to vaporize any water contacting the surface from crude oil to be treated in the dehydrator. It has been found important to maintain a substantially uniform temperature at or below the vaporizing surface in order to effectively treat crude oil for dewatering purposes. Significant temperature fluctuations are typically realized by dehydrators since heat enthalpy is removed in order to vaporize the water in the crude oil. Such fluctuations lead to process complications and upset and are therefore undesirable. The instant invention recognizes this limitation and substantially reduces foaming and provides for a smoothly running and efficient dehydration process.

21 Claims, 4 Drawing Sheets

U.S. PATENT DOCUMENTS

| | | | | | |
|---|---|---|---|---|---|
| 4,029,568 | A | | 6/1977 | Pittman et al. | 208/11 |
| 4,046,669 | A | | 9/1977 | Blaine et al. | 208/11 |
| 4,057,485 | A | | 11/1977 | Blaine et al. | 208/11 |
| 4,057,486 | A | | 11/1977 | Meadus et al. | 208/11 |
| 4,068,717 | A | | 1/1978 | Needham | 166/272 |
| 4,071,433 | A | | 1/1978 | Hanson | 208/11 |
| 4,071,434 | A | | 1/1978 | Gifford, II | 208/11 |
| 4,084,938 | A | | 4/1978 | Willard, Sr. | 44/1 |
| 4,108,760 | A | | 8/1978 | Williams et al. | 208/11 |
| 4,109,715 | A | | 8/1978 | Adamson | 166/177 |
| 4,110,194 | A | | 8/1978 | Peterson et al. | 208/11 |
| 4,110,195 | A | | 8/1978 | Harding | 208/11 |
| 4,114,691 | A | | 9/1978 | Payton | 166/276 |
| 4,133,742 | A | | 1/1979 | Hill | 208/11 |
| 4,160,479 | A | | 7/1979 | Richardson et al. | 166/267 |
| 4,160,720 | A | | 7/1979 | Seader et al. | 208/11 |
| 4,161,428 | A | | 7/1979 | Gottschlich et al. | 196/14.52 |
| 4,197,190 | A | | 4/1980 | Foster | 208/187 |
| 4,200,550 | A | * | 4/1980 | Scherrer et al. | 252/335 |
| 4,240,897 | A | | 12/1980 | Clarke | 208/11 |
| 4,242,195 | A | | 12/1980 | Rudnick | 208/11 |
| 4,253,938 | A | | 3/1981 | Roma | 208/11 |
| 4,273,611 | A | | 6/1981 | Blasio et al. | 159/47 |
| 4,329,159 | A | | 5/1982 | Bull | 55/42 |
| 4,338,185 | A | | 7/1982 | Noelle | 208/11 |
| 4,347,119 | A | | 8/1982 | Thomas | 208/11 |
| 4,349,633 | A | | 9/1982 | Worne et al. | 435/281 |
| 4,356,863 | A | * | 11/1982 | Furr | 165/1 |
| 4,361,476 | A | | 11/1982 | Brewer | 208/11 |
| 4,364,776 | A | | 12/1982 | McBride et al. | 134/10 |
| 4,368,111 | A | | 1/1983 | Siefkin et al. | 208/11 |
| 4,379,489 | A | | 4/1983 | Rollmann | 166/266 |
| 4,396,491 | A | | 8/1983 | Stiller et al. | 208/11 |
| 4,410,042 | A | | 10/1983 | Shu | 166/261 |
| 4,413,914 | A | | 11/1983 | McBride et al. | 366/137 |
| 4,419,214 | A | | 12/1983 | Balint et al. | 208/8 |
| 4,427,528 | A | | 1/1984 | Lindörfer et al. | 208/11 |
| 4,436,710 | A | | 3/1984 | Miyazaki et al. | 423/552 |
| 4,437,998 | A | | 3/1984 | Yong | 210/728 |
| 4,458,756 | A | | 7/1984 | Clark | 166/260 |
| 4,475,592 | A | | 10/1984 | Pachovsky | 166/272 |
| 4,487,262 | A | | 12/1984 | Venkatesan | 166/271 |
| 4,487,264 | A | | 12/1984 | Hyne et al. | 166/300 |
| 4,488,600 | A | | 12/1984 | Fan | 166/263 |
| 4,498,971 | A | | 2/1985 | Angelov et al. | 208/11 |
| 4,501,328 | A | | 2/1985 | Nichols | 166/288 |
| 4,503,911 | A | | 3/1985 | Hartman et al. | 166/272 |
| 4,516,636 | A | | 5/1985 | Doscher | 166/272 |
| 4,519,894 | A | | 5/1985 | Walker | 208/11 |
| 4,521,292 | A | | 6/1985 | Spars et al. | 208/11 |
| 4,565,249 | A | | 1/1986 | Pebdani | 166/303 |
| 4,566,537 | A | | 1/1986 | Gussis | 166/261 |
| 4,610,304 | A | | 9/1986 | Doscher | 166/261 |
| 4,617,272 | A | | 10/1986 | Kirkwood et al. | 435/183 |
| 4,623,447 | A | | 11/1986 | Clampitt et al. | 208/187 |
| 4,634,520 | A | | 1/1987 | Angelov et al. | 208/309 |
| 4,635,720 | A | | 1/1987 | Chew | 166/245 |
| 4,638,864 | A | | 1/1987 | Bousaid | 166/251 |
| 4,648,962 | A | | 3/1987 | Capes et al. | 208/188 |
| 4,673,484 | A | | 6/1987 | Babcock et al. | 208/435 |
| 4,688,550 | A | | 8/1987 | Lopes | 126/378 |
| 4,702,487 | A | | 10/1987 | Stoian et al. | 208/390 |
| 4,719,008 | A | | 1/1988 | Sparks et al. | 208/390 |
| 4,757,618 | A | | 7/1988 | Mihalov | 34/73 |
| 4,762,812 | A | | 8/1988 | Lopez et al. | 502/26 |
| 4,783,268 | A | | 11/1988 | Leung | 210/703 |
| 4,789,461 | A | * | 12/1988 | Clare et al. | 208/187 |
| 4,806,231 | A | * | 2/1989 | Chirinos et al. | 208/251 R |
| 4,822,481 | A | | 4/1989 | Taylor | 208/390 |
| 4,846,275 | A | | 7/1989 | McKay | 166/272 |
| 4,929,341 | A | | 5/1990 | Thirumalachar et al. | 208/390 |
| 4,966,685 | A | | 10/1990 | Hall et al. | 208/390 |
| 4,968,410 | A | * | 11/1990 | Johnson, Sr. | 208/187 |
| 4,994,174 | A | | 2/1991 | Künstle et al. | 208/417 |
| 5,000,872 | A | | 3/1991 | Olah | 252/314 |
| 5,024,676 | A | | 6/1991 | Moriyama et al. | 44/301 |
| 5,056,596 | A | | 10/1991 | McKay et al. | 166/272 |
| 5,096,567 | A | | 3/1992 | Paspek, Jr. et al. | 208/106 |
| RE33,999 | E | * | 7/1992 | Clare et al. | 208/187 |
| 5,145,002 | A | | 9/1992 | McKay | 166/272 |
| 5,152,886 | A | | 10/1992 | Paris-Marcano | 208/390 |
| 5,223,148 | A | | 6/1993 | Tipman et al. | 210/744 |
| 5,249,844 | A | | 10/1993 | Gronseth | 299/17 |
| 5,320,746 | A | | 6/1994 | Green et al. | 208/391 |
| 5,411,558 | A | | 5/1995 | Taniguchi et al. | 44/301 |
| 5,437,693 | A | | 8/1995 | Iizuka et al. | 44/302 |
| 5,480,566 | A | | 1/1996 | Strand | 210/772 |
| 5,492,628 | A | | 2/1996 | Schutte | 210/696 |
| 5,607,574 | A | * | 3/1997 | Hart | 208/188 |
| 5,681,452 | A | | 10/1997 | Kirkbridge | 208/390 |
| 5,746,932 | A | | 5/1998 | Rendall et al. | 252/62 |
| 5,762,780 | A | | 6/1998 | Rendall et al. | 208/391 |
| 5,772,127 | A | | 6/1998 | Maciejewski et al. | 241/21 |
| 5,795,444 | A | | 8/1998 | Rendall et al. | 196/46.1 |
| 5,816,790 | A | | 10/1998 | Ichinose et al. | 431/4 |
| 5,826,655 | A | | 10/1998 | Snow et al. | 166/272.3 |
| 5,846,314 | A | | 12/1998 | Golley | 106/705 |
| 5,868,202 | A | | 2/1999 | Hsu | 166/256 |
| 5,871,053 | A | | 2/1999 | Stern | 166/401 |
| 5,876,592 | A | | 3/1999 | Tipman et al. | 208/390 |
| 5,902,554 | A | | 5/1999 | Kirkbride | 422/141 |
| 5,928,495 | A | | 7/1999 | Legkow | 208/13 |
| 5,942,469 | A | | 8/1999 | Juprasert et al. | 507/202 |
| 5,948,242 | A | | 9/1999 | Ohsol et al. | 280/181 |
| 5,951,868 | A | * | 9/1999 | Padron | 210/634 |
| 5,957,202 | A | | 9/1999 | Huang | 166/272.3 |
| 5,961,821 | A | | 10/1999 | Varadaraj et al. | 208/263 |
| 5,989,436 | A | | 11/1999 | Suzumura et al. | 210/708 |
| 5,998,640 | A | | 12/1999 | Haefele et al. | 554/12 |
| 6,004,455 | A | | 12/1999 | Rendall | 208/390 |
| 6,027,056 | A | | 2/2000 | Maciejewski et al. | 241/62 |
| 6,030,424 | A | | 2/2000 | Matsumoto | 44/301 |
| 6,036,473 | A | | 3/2000 | Ichinose et al. | 431/4 |
| 6,056,050 | A | | 5/2000 | Snow et al. | 166/57 |

* cited by examiner

METHOD OF REMOVING WATER AND CONTAMINANTS FROM CRUDE OIL CONTAINING SAME

FIELD OF THE INVENTION

The present invention is directed to an enhanced crude oil dehydration process and apparatus, and more particularly the present invention is directed to a crude oil dehydration process which can overcome the instability problems encountered with prior art for treating high water cut heavy oil streams, provide enhanced thermal energy input and recovery methods and remove suspended and dissolved compounds from inlet feed.

BACKGROUND OF THE INVENTION

Throughout many regions of the world, heavy oil, a hydrocarbon material having much higher viscosity or lower API gravity (less than 20° API, typically 7° to 12° API) than conventional petroleum crude, is being economically recovered for commercial sale. During the recovery process and prior to the transport to refineries for upgrading, the heavy oil receives preliminary treatment for water and solids removal to generally achieve basic sediment and water (BS & W) content less than 0.5% by volume and chloride content less than 30 ppm (wt). Water content of the treated heavy oil typically is required to be 0.3% by volume or less.

Conventional crude oil treatment methods were proven to be ineffective with respect to heavy oil until the advent of the technology set forth in U.S. Pat. Reissue No. 33,999, Clare et al., reissued Jul. 21, 1992 and Canadian Patent 1,302,937, Clare et al., reissued on Jun. 9, 1992. These patents describe a simple apparatus which can be located in remote oil producing areas for dehydrating heavy oil with low risk of foaming and unstable operating, while continuously achieving dry oil which exceeds requisite specifications. These dehydrators were found to be restricted to feed oil water content of less than 5% water cuts and susceptible to foaming and process instability during high water feed rates. Throughout the operation of several of these dehydrators known from practicing the technology in patents Re33,999 and U.S. Pat. No. 1,302,937, areas for improvement were discovered to overcome the limitations of feed oil water content and unstable operation caused by pretreatment upsets.

Further, additional problems have been experienced with the prior art in that although dehydrated heavy oil is achieved, high concentrations of suspended solids, such as clay and silica and dissolved compounds such as chlorides remain in the treated oil. These undesirable compounds continue to create many problems in pipeline transportation systems and refinery facilities to the extent that they depreciate the commercial valve of heavy oil.

Accordingly, one object of the present invention is to provide advances to overcome the limitations encountered by the previous art.

SUMMARY OF THE INVENTION

One object of the present invention is to provide for a dry crude oil recycle stream around the dehydrator to mix with the feed to reduce the ratio of residual water to oil contacting the oil surface of the dehydrator and thereby allow for higher raw crude oil water cuts, while maintaining a stable dehydration operation.

A further object of one embodiment of the present invention is to provide a method of removing water from crude oil containing water, comprising of steps of a) providing a source of crude oil containing water;
b) providing a dehydrator for dehydrating the crude oil containing water, the dehydrator having an inlet and an outlet and a vaporizing surface of dry crude oil at temperatures sufficient to vaporize water contacting the surface;
c) exposing the source of crude oil to the dry crude;
d) vaporizing the water in the source; and
e) re-circulating at least a portion of dehydrated crude oil for contact with at least one of the dehydrator or the source of crude oil for maintaining a substantially uniform temperature at the vaporizing surface.

Conveniently, when at least a portion of the dry crude oil recycle stream around the dehydrator enters the dehydrator and is distributed below the surface of the hot crude oil in the dehydrator a consistent temperature is maintained at or above the vaporization temperature of water and at or below the surface of the oil and throughout the contained oil, thereby providing a means to mitigate the risk of process upsets and instability due to foaming.

A further object of the present invention is to provide a dry crude recycle stream around the dehydrator to mix with the feed stream, to allow an input of supplemental heat energy (external or waste heat energy) or recovery of heat energy from the dehydrator to result in an energetically efficient and balanced process.

A still further object of one embodiment of the present invention is to provide a method of removing water from crude oil containing water, comprising of steps of a) providing a source of crude oil containing water;
b) providing a dehydrator for dehydrating the crude oil containing water, the dehydrator having an inlet and an outlet and a vaporizing surface of dry crude oil at a temperature sufficient to vaporize water contacting the surface;
c) contacting the source and the dry crude oil to flash water from the source to thereby remove the water from the source; and
d) selectively heating the surface of the dry crude to return heat energy lost from flash evaporating water from the source.

The dry crude oil surface may be selectively heated by reintroduction of dry crude oil, auxiliary heat addition, etc. The important aspect is that the heat used for vaporization is replaced so that a uniform or substantially uniform surface temperature is maintained. This is one important unit operation to maintain.

A further object of the present invention is to provide a means to remove suspended solids accumulated in the contained dry crude oil introduced with the source oil or produced during dehydration.

Suspended solids in the dry crude oil recycle stream, may be removed by a separator means on a continuous or batch basis to avoid buildup, plugging, and other complications.

A further object of the present invention is to water wash the raw crude oil source combined with the treatment in the dehydrator to remove the soluble dissolved solids or contaminants introduced the source crude oil and generate a low conductivity produced water and clean dry crude oil.

Until the advent of the present invention, prior art methods related to heavy oil dehydration had been limited by the stability of operation and risk of foaming, level of water cut or emulsion level in the heavy oil feed and the level of chloride, clay and silica compounds in the dry sales crude oil.

A still further object of one embodiment of the present invention is to provide a method of removing water from a crude oil containing water, comprising of steps of:

a) providing a source of crude oil containing water;

b) providing a dehydrator for dehydrating the crude oil containing water, the dehydrator having an inlet and an outlet and a vaporizing surface of dry crude oil at a temperature sufficient to vaporize water contacting the surface;

c) pre-washing the source of crude oil containing water to remove alkali metals and alkaline earth metals;

d) separating the alkali metals and the alkaline earth metals and oil in a preliminary separation step;

e) passing washed oil into the dehydrator to flash evaporate water from the washed oil to remove water therefrom;

f) selectively pre-heating crude oil to be treated in the dehydrator with treated dehydrated crude oil from the dehydrator to return heat energy lost from flash evaporating water; and g) maintaining a uniform surface temperature.

Enhancements have been developed to eliminate the limits imposed by water cut of the source crude oil feed and to provide a very clean and dry heavy oil product relatively free of water, solids and chlorides.

The present invention relates to process enhancements to an apparatus used for dehydrating crude oil containing water, comprising a casing, means for admitting and distributing the liquid crude oil into the casing and onto the host surface of the dry crude oil, means for controlling the level of crude oil and a means to transfer heat energy sufficient to maintain the liquid oil at or above the distillation temperature for evaporating water and light hydrocarbons.

The light hydrocarbons and water exiting the casing are condensed by any suitable means known in the art, and collected and separated into water and light hydrocarbon liquid phases. Any non-condensible vapors are released from the apparatus for disposition by any safe means. Dry crude oil meeting pipeline BS & W specifications is pumped from the dehydrator for transport to refining and upgrading operations.

Typically, the dehydrator taught in the current art performed well to produce dry crude oil, however several problems have been encountered:

1. The dehydrator was limited to crude oil feed water cuts (wc) of less than 10% water to oil, and more specifically less than 5% wc to reduce the risk of unstable operation with foaming tendencies. This required the need for a conventional treater means upstream of the dehydrator to reduce raw crude oil water cuts from 50 to 20% wc down to less than 5% wc prior to feeding the dehydrator.

2. The dry crude oil exiting the dehydrator contains high chloride content, causing metallurgy and corrosion problems with downstream refineries facilities and transportation pipelines.

3. It was found that by flash evaporating off the water and by effectively eliminating all emulsions, solids such as clays and silica compounds, concentrated in the dry oil phase, had a tendency to buildup, plug and/or cause heat element damage.

4. It has been further experienced that the dehydrator is susceptible to unstable operations and foaming tendencies causing dehydration temperature swings and wet oil production.

The present invention seeks to address these concerns by providing methodology and apparatus to exceed the performance of the dehydrator beyond the prior art.

In one embodiment of the invention, at least a portion of the dry crude oil exiting the dehydrator is recycled and mixed with the inlet crude oil feed prior to entering the dehydrator casing. By increasing recycle flow, a consistent and stable inlet water cut composition can be maintained at the entrance to the casing to control the tendency to foam and create operational complications. With greater recycle rates, the raw water cut levels can be increased above the 10% wc stable level and continuous stable operation is maintained. This eliminates the need for conventional treatment ahead of the dehydrator and can avoid dehydrator process upset if an upstream treater is used and a treater upset occurs.

A further embodiment of the invention requires that at least a portion of the recycled dry crude oil be recycled and distributed immediately below the dry crude oil evaporating surface. This method ensures that the temperature of the surface of the dry oil in the dehydrator is maintained at or above the flash evaporating temperature of water. Water droplets from the feed are not permitted to penetrate the surface of the crude oil, thereby preventing the cooling below the surface and creating surface breakdown foaming and unstable dehydrator operation.

Advantageously, external heat transfer means can be added to the recycle circuit supra to regulate the precise temperature of the feed stream to the dehydrator casing. This method enhancement will regulate the precise level of pre-flashing of water vapour in the feed oil to control the residual water level contacting the hot dry oil surface. This step can be used to prevent the overcooling of the bath and eliminate the foaming effects caused by excessive evaporation surface breakdown.

The external heat transfer means can also be used to cool the feed stream. This may be used if the raw crude oil feed stream already contains sufficient or excessive thermal energy required to flash or distill the water vapor. Cooling the feed stream can regulate the flashing operation and prevent process complications.

As a further feature, a solid/liquid separation device, examples of which include a filter, hydro cyclone, centrifugal separators, gravity separators, centrifuge or any combination thereof, etc., may be employed in the circuit of the recycle stream continuously or on a batch basis to remove suspended solids from the hot dry oil.

Additionally, a clean water washing circuit may be added to the dehydrator feed to reduce undesirable dissolved compounds, such as chlorides, from the dry crude oil. The entire contaminated water stream, or a portion thereof, is treated by a suitable treatment method to create a clean water stream and a highly concentrated brine, slurry or solid product. The recovered clean water is recycled back to the raw crude oil for oil pretreatment. Generally water or any aqueous solution containing compounds for enhancing the extraction of chloride is most desirable, otherwise any regenerable fluid with a suitable aggressive solubility for chlorides may be considered.

It is preferable that in addition to achieving a dehydrated oil, having a BS&W content of less than 0.5% wc by volume, the embodiments of the invention in combination, or separately applied, can produce a dry clean crude oil, substantially free of solids, containing less than 30 ppm (wt) chlorides, in a continuous and stable operation, with low risk of foaming and process upsets. The oil produced by the present process is readily vendible and is most desirable, particularly in the case of heavy crude oils with gravities in the 7° API to 20° API range.

Having thus described the invention, reference will now be made to the accompanying drawings illustrating preferred embodiments.

BRIEF DESCRIPTION OF THE DRAWINGS

Similar numerals employed in the Figures denote similar elements.

DETAILED DESCRIPTION OF THE PREFERRED EMBODIMENTS

Figure 1:
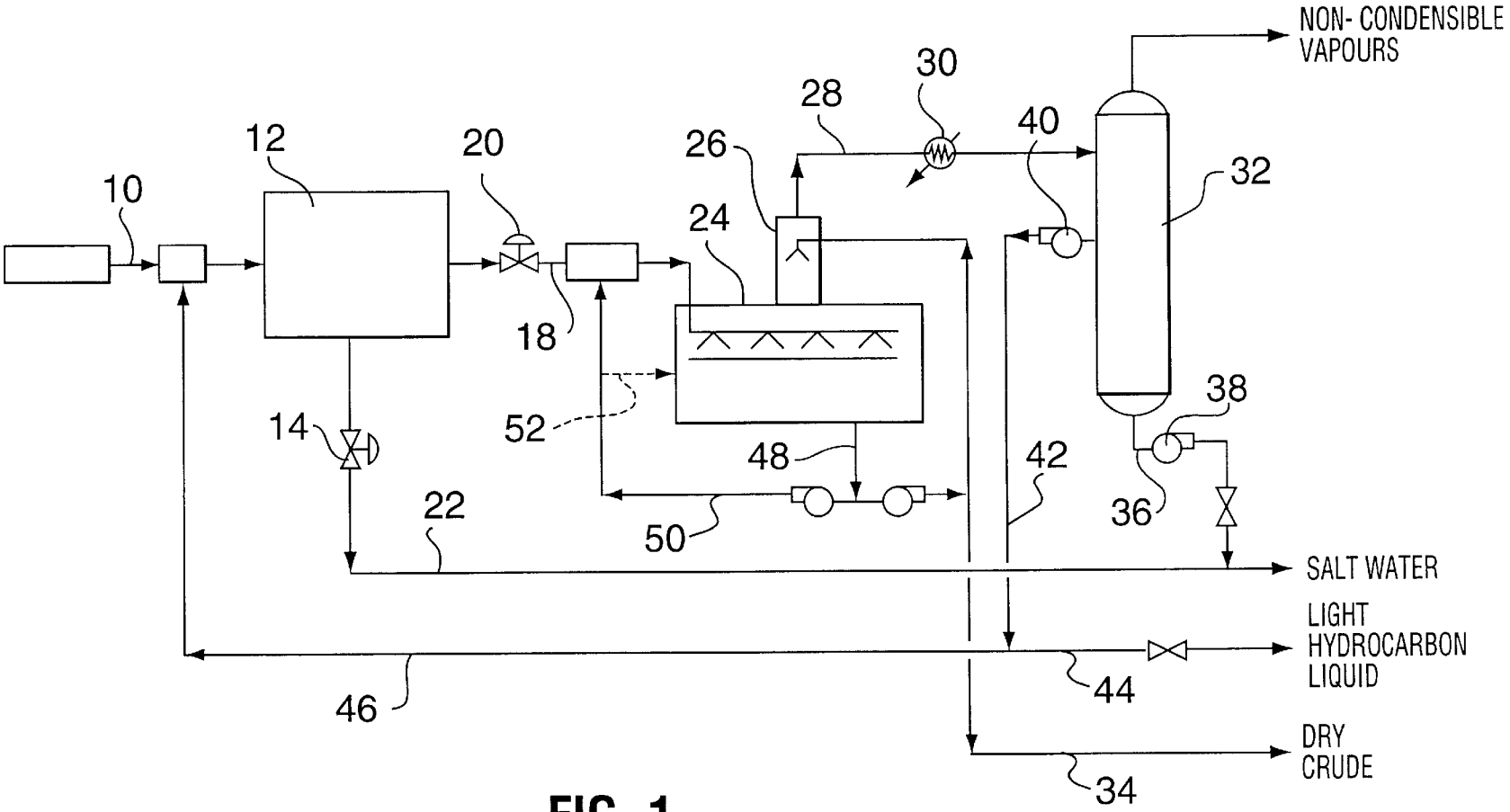
FIG. 1 is a schematic flow diagram which illustrates the dry oil recycle to the dehydrator feed stream and dehydrator.

With reference to FIG. 1, heavy oil with a viscosity of between 7° API and 20° API denoted by numeral 10, typically includes a mixture of crude oil, water, oil/water emulsion, dissolved compounds such as chlorides and solid particles such as clay, metals and silicas. The crude oil is generally received in a gravity separator, heated or non heated treater 12, under pressure from between atmospheric pressure to 100 psig. Heated treaters typically operate from 170° F. to 285° F. (77° C. to 141° C.). In the treaters, solid particles and bulk brackish water is separated and removed from the raw crude oil at 14. Water cuts of less than 10%, to more typically 5% by volume can be achieved in the raw crude feed 18 exiting the primary treatment through a valve member 20. The water stream 22 generally contains dissolved compounds such as sodium chloride, (5,000 to 50,000 ppm (wt)) and silica, and suspended compounds such as clay and sand.

The raw crude oil at approximately 5% water cut in the emulsion form, containing no free water, enters the dehydrator 24 where the crude oil and emulsions are evenly distributed onto the hot surface of dry crude oil (not shown), operating at or above the evaporation temperatures of the water. Water is flashed off the oil or separated by distillation, with water and low boiling temperature hydrocarbon components from the oil exiting through the column 26 and passing through line 28. If desired, the water and lower boiling components may be sent to a condenser 30 and subsequently to a vapor liquid separator 32. Dehydrated higher boiling point crude oil is discharged from the dehydrator 24 through line 34.

In the separator 32, water and light hydrocarbons are separated by differences in specific gravity. The water is discharged through line 36 and pump 38. The light hydrocarbons are transferred from the separator 32 using pump 40 via line 42, and can be removed for disposal at line 44 or at least a portion recycled and mixed with the inlet crude oil 10 via line 46, to dilute the incoming crude oil and thereby facilitate its further treatment. Non condensible, i.e. light hydrocarbons, inert gases (nitrogen, carbon dioxides, hydrogen sulfide) are vented from separator 32 and disposed of or recovered by any suitable safe means.

As shown by FIG. 1, dry oil can be recycled from 48 and recycled as stream 50 to mix with the inlet feed 18, prior to being distributed onto the hot oil surface in the dehydrator 24.

In order to maintain the temperature of the hot oil surface, at least a portion of the recycle stream 50 can be recycled directly to the dehydrator 24 and be distributed at or immediately below the surface of the hot dry crude oil. It has been found that by recycling the dry crude oil to inlet stream 18, and separately or in combination with recycling dry crude oil to the surface of the hot bath by using stream 52 (dashed lines), the following significant benefits can be realized:

a) The water cut of the raw crude oil at stream 18 can be increased to greater than 10%, and even greater than 20% by volume. This enhancement means that the requirement for conventional treatment denoted as 12 can be eliminated, without risk of process instability and foaming of the dehydrator.

b) If a conventional primary treatment 12 is used, the recycle stream can be used to isolate the dehydrator from unstable or operational complications if the pretreatment becomes unstable. This means that the dry crude oil sales specification is not at risk, and rerun of off spec sales oil from sales oil storage tanks and pipelines is avoided.

The ratio of recycle at 50 to inlet feed can vary depending on the actual temperature and rate of the recycle 52 and the level of feed conditioning and water cut reduction required at the inlet to the dehydrator. Similarly, the ratio of recycle 52 to recycle 50 will vary for each application in order to establish a balance between dehydrator feed conditioning and dehydrator surface temperature. Depending on the relative size of oil recycle 50 to dry sales oil 34, common pumps or separate pumps may be used, as known to those skilled in the art. Recycle 52 can also be provided by separate pumping means.

Figure 2:
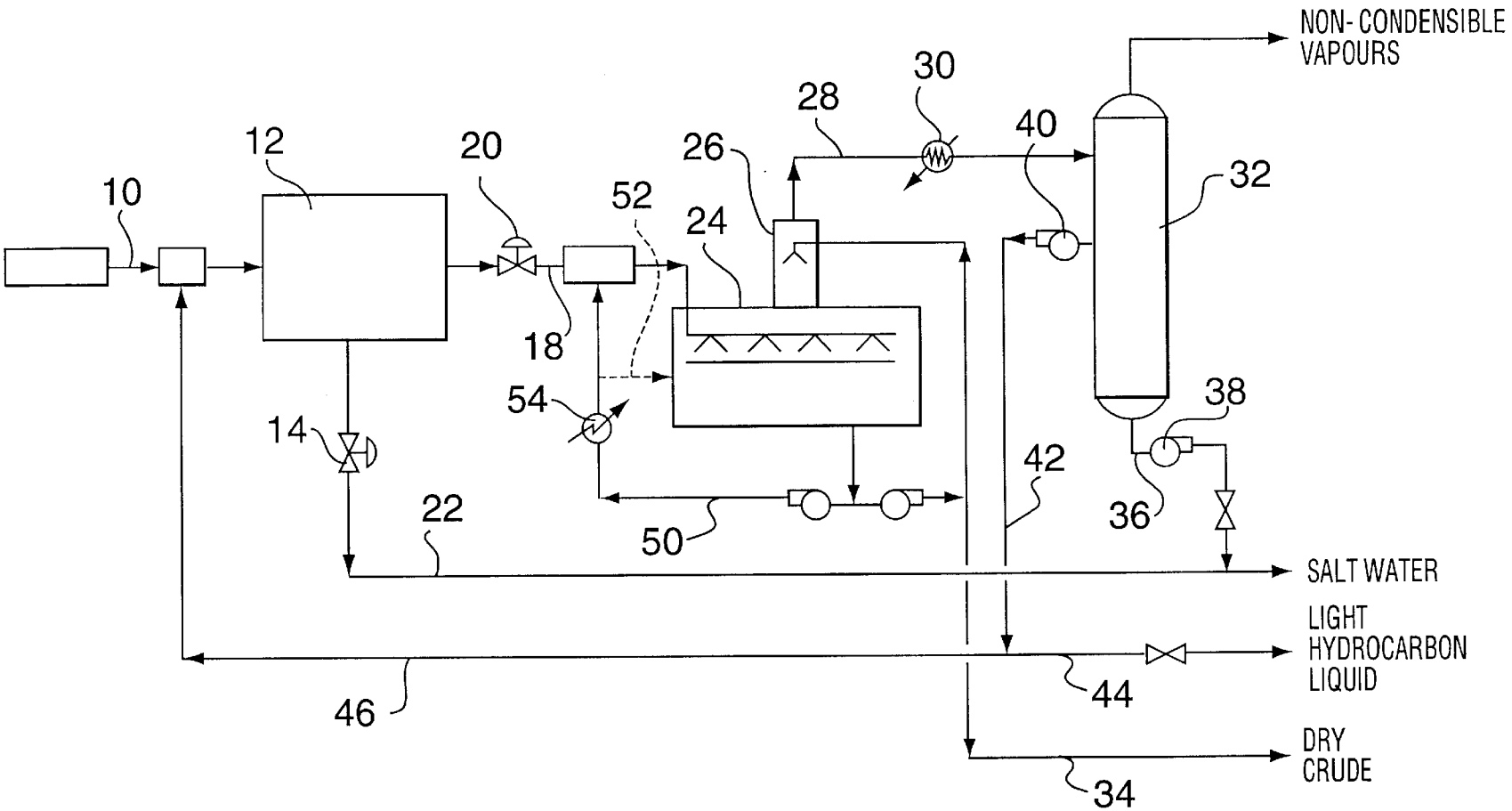
FIG. 2 is an additional schematic flow diagram showing external heat exchange on the recycle for temperature adjustment of the feed or surface of the dehydrator or both.

Referring to FIG. 2, shown is an enhancement to the recycle variation of FIG. 1, where a heat exchanger means 54 is added to the recycle circuit to condition the temperature for steams 56 and 52. The streams, 56 and 52 can be heated or cooled to the same temperature or independently to separate temperatures in order to seek the thermal balance of the feed stream and hot crude oil bath surface. Any form of suitable heat source, such as direct fired heaters, indirect fired heaters, heat exchangers or heat recovery or cooling apparatus may be selected. A further consideration for temperature at the streams 56 and 52 is whether the feed is from a heated primary treatment means at 170° F. to 285° F. (77° C. to 141° C.) or from a raw crude storage tank at 60° F. to 100° F. (16° C. to 38° C.).

Figure 3:
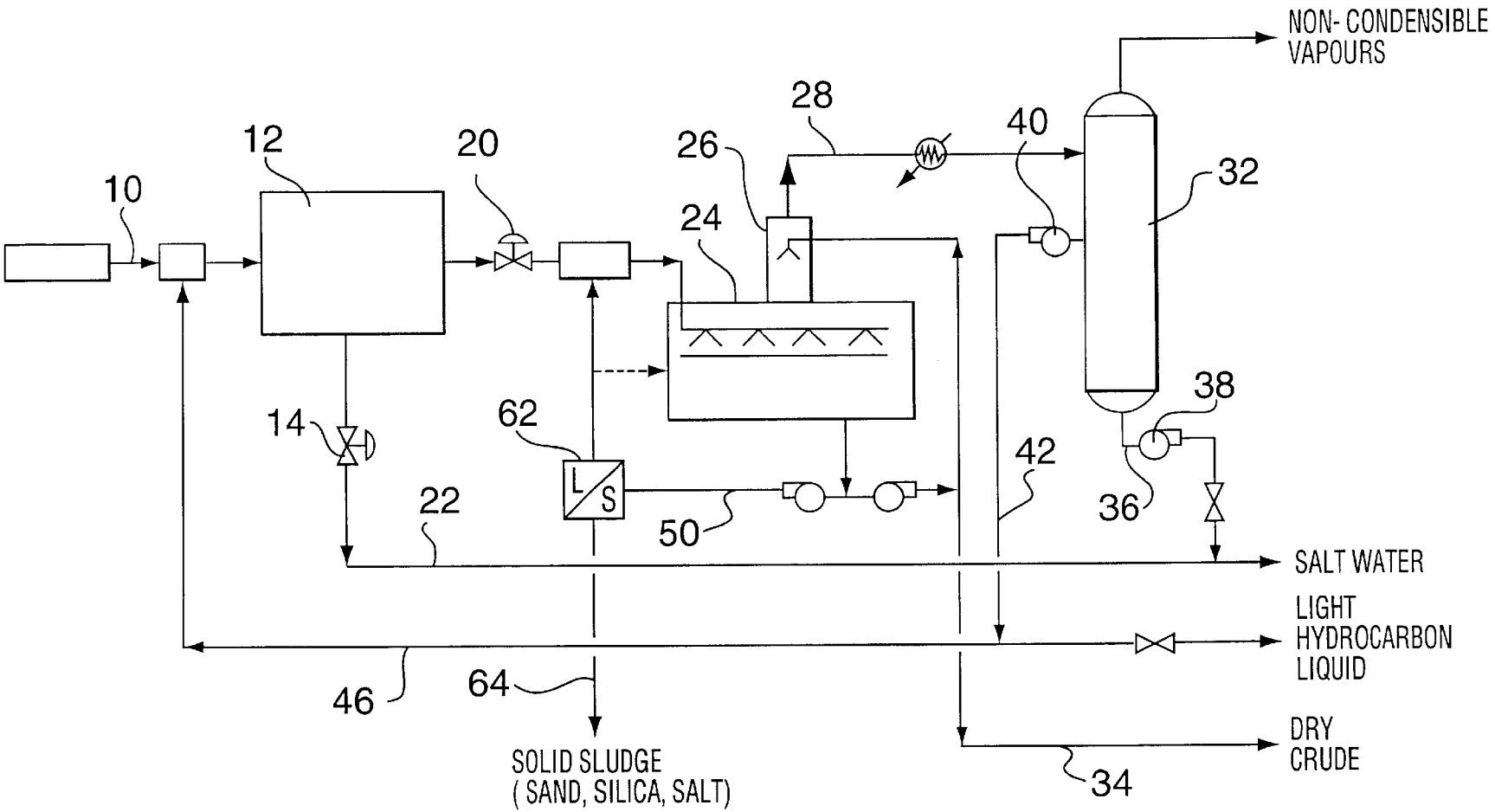
FIG. 3 is a further schematic flow diagram showing a solid/liquid separator for removal of suspended solids.

FIG. 3 illustrates an additional enhancement to include a solid/liquid separator means 62, used to remove suspended solids such as clay, sand, and precipitated salts from the dehydrated crude oil. The solid/liquid separator 62 may be selected from any suitable separator device known to those skilled in the art, such as gravity separators, clarifiers, filter, screens, cyclones and centrifuges. The recycle stream from 50, is sized to satisfy the range of operation of the solid/liquid separator device 62 and specifically sized to accommodate a solids removal rate at 64 greater or equal to the solids content entering the dehydrator 24 at 18 and being produced in the dehydration process.

The removal of the solids can be performed on a continuous or batch basis and primarily allow for the ongoing removal of solids from the dehydrator 24 to prevent buildup and plugging. Buildup of solids on the heating elements contained in 24 or external to 24 is detrimental to the elements performance and can become a safety issue.

Figure 4:
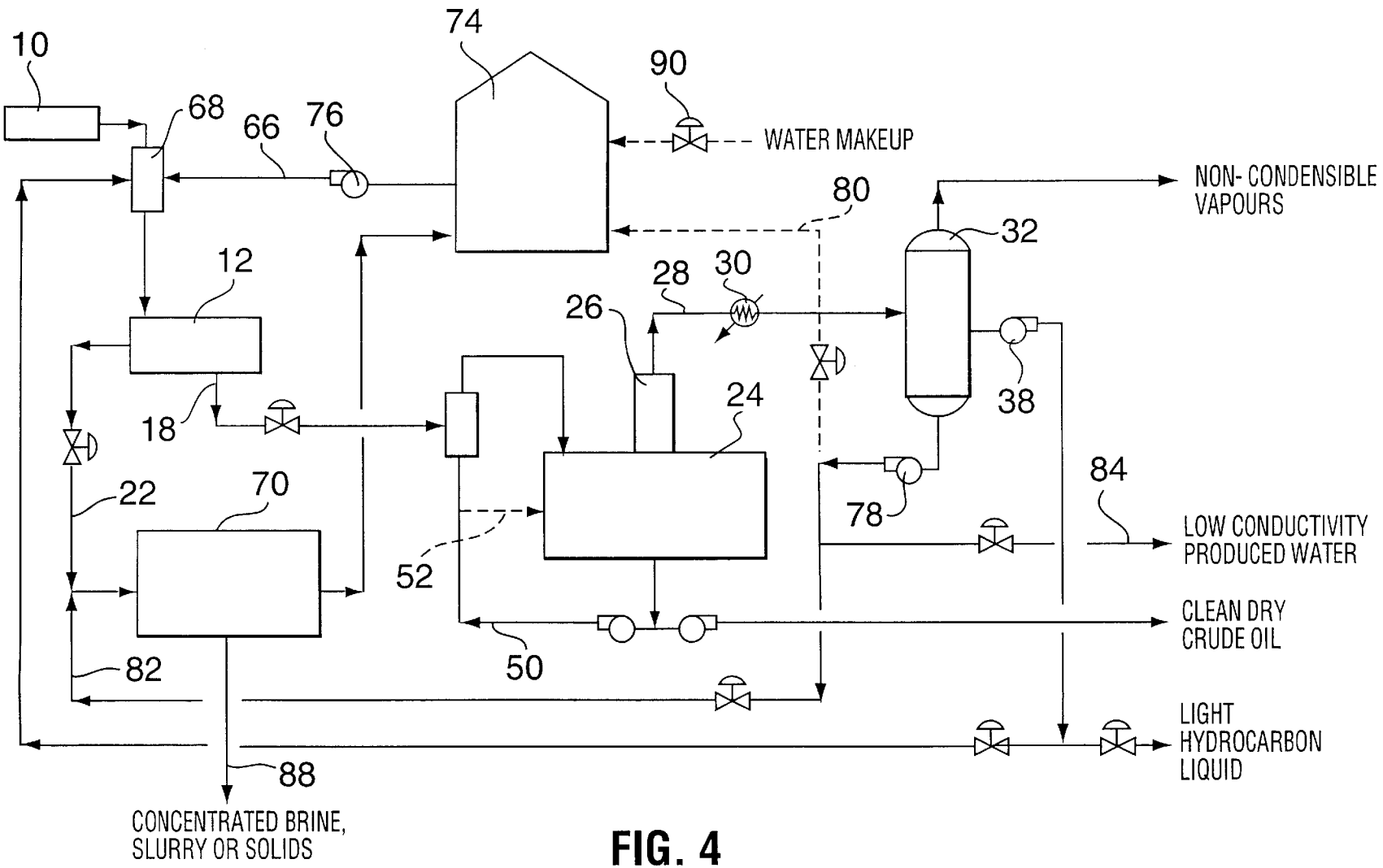
FIG. 4 is a schematic flow diagram illustrating the addition of water washing for removal of dissolved compounds such as chlorides.

Turning to FIG. 4, shown is a further variation of the invention showing the addition of a water wash means to the dehydrator to remove dissolved solids. The raw crude oil can contain high concentrations of sodium, calcium, magnesium, chlorides, .sulfur, carbonates, silica, etc. All these compounds, especially the chloride are currently undesirable in the dry crude sales product and may have significant commercial impact on the price for the crude oil, or even restrict sales. Typically, refineries are currently requiring less than 30 ppm(wt) chlorides in the sales crude oil.

Using the enhancement shown by FIG. 4, clean water 66 is injected and intimately mixed with the raw. crude oil 10 at 68. The feed mixture 10 is passed through primary treatment separator at 12. The bulk of the brine contaminated water is separated from the oil and discharged through line 22 to a water treatment unit 70.

The washed crude oil is discharged at 18 and becomes the feed stream to the dehydrator. The feed can be conditioned either in the primary treatment 12 or by using the recycle stream 50 and 52 to ensure stable dehydrator 24 operation. The washed crude at 18 contains significantly reduced levels of dissolved compounds, meeting or exceeding the sales oil specification requirements.

The water treatment scheme selected for each application must ensure that the undesirable compounds in stream 22 are sufficiently removed to satisfy the process removal requirements at 18. Typical water treatment practices, are microfiltration, reverse osmosis, distillation, flocculation, clarification and coagulation.

Treated water 72 enters the treated water surge vessel 74 and is transferred by pump 76 for reinjection at 68 using line 66.

As an option, condensed water from the separator 32 can be transferred directly by pump 78 to either the treated water surge tank 74 by line 80 or to a water treatment unit 70 by line 82 if water treatment is required. The net water production would discharge from the separator 32 at stream 84, or from the water treatment unit 70 by means of stream 88. Fresh water makeup can be introduced to the treated water storage tank 74 at 90 if a water balance deficit is encountered.

By following the enhancements independently or in combination, the process methods as described by this invention, will result with dry clean crude oil meeting or exceeding new sales specifications for commercial sale.

Although embodiments of the invention have been described above, it is not limited thereto and it will be apparent to those skilled in the art that numerous modifications form part of the present invention insofar as they do not depart from the spirit, nature and scope of the claimed and described invention.

We claim:

1. A method of removing water from crude oil containing water, comprising of steps of:

a) providing a source of crude oil containing water;

b) providing a dehydrator for dehydrating said crude oil containing water, said dehydrator having an inlet and an outlet and a vaporizing surface of dry crude oil at temperatures sufficient to vaporize water contacting said surface;

c) exposing said source of crude oil to said dry crude;

d) vaporizing at least a portion of said water in said source;

e) re-circulating at least a portion of dehydrated crude; and f) contacting re-circulated dehydrated crude with said source of crude oil immediately below said vaporizing surface for maintaining a substantially uniform temperature of said vaporizing surface.

2. The method as defined in claim 1, wherein said temperature is a flash evaporating temperature for water.

3. The method as defined in claim 1, including preconditioning said source for removal of solids and minerals.

4. The method as defined in claim 1, including preconditioning with separation means for separating said solids and minerals from said source crude oil.

5. The method as defined in claim 1, further including the step of collecting gaseous components from said vaporizing and condensing said components.

6. The method as defined in claim 1, further including the step of regulating heat content of said dehydrated crude re-circulated with heating means.

7. The method as defined in claim 1, wherein said source of said dry crude oil has an API index of between 7° API and 20° API.

8. The method as defined in claim 1, wherein in said dehydrated crude has a basic sediment water content of less than 0.5% by volume water.

9. The method as defined in claim 1, wherein said source of crude oil contains greater than 5% by volume water.

10. The method as defined in claim 1, further including step of collecting and condensing vaporized water.

11. The method as defined in claim 1, further including a step of collecting and condensing light hydrocarbon fluid.

12. The method as defined in claim 10, further including the step of purifying said condensed water.

13. The method as defined in claim 10, further including the step of re-circulating condensed light hydrocarbon fluid to said source of crude oil.

14. The method as defined in claim 11, further including the step of diluting said source of crude oil with condensed light hydrocarbon fluid.

15. A method of removing water from a crude oil containing water, comprising of steps of:

a) providing a source of crude oil containing water;

b) providing a dehydrator for dehydrating said crude oil containing water, said dehydrator having an inlet and an outlet and a vaporizing surface of dry crude oil at a temperature sufficient to vaporize water contacting said surface;

c) contacting said source and said dry crude oil to flash water from said source to thereby remove said water from said source;

d) re-circulating said dry crude oil for contact immediately below said vaporizing surface; and e) re-circulating said dry crude oil for mixing with said source of crude oil, whereby said vaporizing surface is selectively heated to return heat energy lost from flash evaporating water from said source.

16. The method as defined in claim 15, wherein prior to step b), said source is pre-conditioned.

17. The method as defined in claim 16, wherein in preconditioning includes removal of solid and mineral from said source.

18. A method of removing water from crude oil containing water, comprising of steps of:

a) providing a source of crude oil containing water;

b) providing a dehydrator for dehydrating said crude oil containing water, said dehydrator having an inlet and an outlet and a vaporizing surface of dry crude oil at a temperature sufficient to vaporize water contacting said surface;

c) pre-washing said source of crude oil containing water to remove alkali metals and alkaline earth metals;

d) separating said alkali metals and said alkaline earth metals and oil in a preliminary separation step;

e) passing washed oil into said dehydrator to flash evaporate water from said washed oil to remove water therefrom;

f) pre-heating crude oil to be treated in said dehydrator with treated dehydrated crude oil from said dehydrator to return heat energy lost from flash evaporating water;

g) re-circulating said dry crude oil for contact immediately below said vaporizing surface of said dry crude oil, whereby a uniform surface temperature of said vaporizing surface is maintained.

19. The method as defined in claim 16, further including the step of collecting gaseous vapors evolving from said dehydrator.

20. The method as defined in claim 16, further including the step of collecting light hydrocarbon liquids formed during dehydration.

21. The method as defined in claim 16, wherein separated minerals are collected in a concentrated brine.

* * * * *